US007501598B2

(12) United States Patent
Stepniak et al.

(10) Patent No.: US 7,501,598 B2
(45) Date of Patent: Mar. 10, 2009

(54) CONNECTOR SYSTEM FOR AN INSULATED SWITCH WITH PROVISION FOR GROUNDING AND VISIBLE BREAK

(75) Inventors: Frank M. Stepniak, Hackettstown, NJ (US); Larry Siebens, Asbury, NJ (US); Anthony Reed, Port Murray, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 97 days.

(21) Appl. No.: 11/512,020

(22) Filed: Aug. 29, 2006

(65) Prior Publication Data

US 2007/0278188 A1 Dec. 6, 2007

Related U.S. Application Data

(60) Provisional application No. 60/809,695, filed on May 31, 2006.

(51) Int. Cl.
*H01H 33/66* (2006.01)

(52) U.S. Cl. ..... 218/120; 218/140; 218/154

(58) Field of Classification Search ..... 218/7, 218/10, 14, 118, 120, 134–140, 153–155
See application file for complete search history.

(56) References Cited

U.S. PATENT DOCUMENTS

| | | | |
|---|---|---|---|
| 3,399,286 | A | 8/1968 | Kerr |
| 3,956,721 | A | 5/1976 | Link |
| 4,124,790 | A | 11/1978 | Kumbera et al. |
| 4,150,270 | A | 4/1979 | Zunick |
| 4,220,942 | A | 9/1980 | Meister et al. |
| 4,323,874 | A | 4/1982 | Link |
| 4,484,046 | A | 11/1984 | Neuhouser |
| 4,568,804 | A | 2/1986 | Luehring |
| 4,799,895 | A | 1/1989 | Borgstrom |
| 4,865,559 | A | 9/1989 | Clabburn |
| 4,955,823 | A | 9/1990 | Luzzi |
| 5,641,306 | A | 6/1997 | Stepniak |
| 5,667,060 | A | 9/1997 | Luzzi |
| 5,795,180 | A | 8/1998 | Siebens |
| 5,808,258 | A | 9/1998 | Luzzi |
| 5,864,942 | A | 2/1999 | Luzzi |

(Continued)

FOREIGN PATENT DOCUMENTS

WO WO 03/096504 A1 11/2003

*Primary Examiner*—Elvin G Enad
*Assistant Examiner*—Marina Fishman
(74) *Attorney, Agent, or Firm*—Hoffmann & Baron, LLP

(57) ABSTRACT

A connector system for a high voltage vacuum switch which includes: a voltage source connector; a load connector; a first contact in a vacuum bottle; and a second contact connected in series with the first contact, wherein the second contact is external to the vacuum bottle. The voltage source is connected to the load through the first and second contacts and the second contact includes a first separable interface, a second separable interface and a conducting pin. When the conducting pin is removed, an insulating pin can be inserted in its place. In preferred embodiments, the connector system includes a housing and a sight glass which extends through the housing for viewing the conducting pin. The connector system can also include a first and second connectors for the first and second separable interfaces, which are used for test connections and/or grounding connections.

21 Claims, 10 Drawing Sheets

U.S. PATENT DOCUMENTS 5,912,604 A 6/1999 Harvey et al.
5,957,712 A 9/1999 Stepniak
6,168,447 B1 1/2001 Stepniak et al.
6,213,799 B1 4/2001 Jazowski et al.
6,491,548 B2 12/2002 Stepniak et al.
6,504,103 B1 1/2003 Meyer et al.
6,585,531 B1 7/2003 Stepniak et al.
6,825,426 B2 11/2004 Muench et al.
6,843,685 B1 1/2005 Borgstrom et al.
6,939,151 B2 9/2005 Borgstrom et al.
6,984,791 B1 1/2006 Meyer et al.

CONNECTOR SYSTEM FOR AN INSULATED SWITCH WITH PROVISION FOR GROUNDING AND VISIBLE BREAK

This application claims priority from provisional application Ser. No. 60/809,695, filed on May 31, 2006.

FIELD OF THE INVENTION

This invention relates generally to movable, energized contacts for interrupting the flow of electrical current in high voltage electrical circuits. In particular, the invention relates to high voltage vacuum switches and means for electrically grounding the contacts of these switches and visually confirming an open circuit. As used herein, the term "high voltage" means a voltage greater than 1 kV.

BACKGROUND OF INVENTION

High voltage switch assemblies with sub-atmospheric or vacuum type circuit interrupters for electric power circuits and systems are well known in the art. Several examples are shown in U.S. Pat. Nos. 4,568,804; 3,955,167; and 3,471,669. Encapsulated vacuum type switches or circuit breakers are also known and are shown in U.S. Pat. Nos. 3,812,314 and 2,870,298.

In prior art switch assemblies and circuit breakers, a pair of co-acting contacts, one fixed and the other movable, are provided for controlling and interrupting current flow. The contacts are housed in a controlled atmosphere contact assembly, which includes a relatively fragile glass or ceramic housing that is commonly referred to as a "bottle." A metal bellows is typically provided on one end of the bottle, and the movable contact is linked to the inside of the bellows. An operating rod attached to the outside of the bellows actuates the movable contact inside the bottle. The interior of the bottle is maintained under a controlled atmosphere, such as air under a low subatmospheric pressure, to protect the contacts from damage caused by arcing when the contacts are opened and closed. The glass or ceramic wall of the bottle provides a sealed enclosure, which maintains the controlled atmosphere for the life of the device. While efforts have been made to protect and reinforce contact assemblies with solid dielectric materials surrounding the bottles (as illustrated in the patents identified above), there is still a need for further improvements.

In particular, there is a significant, unmet need for an elastomer-insulated switch using a controlled atmosphere contact assembly, which would be suitable for underground power distribution systems and other, similar applications. Switches for use in these applications must meet several demanding requirements. The parts of the switch assembly connected to line voltage during use, including the contact assembly and operating rod, must be encased in a solid insulating housing. The housing must have dielectric strength sufficient to withstand the maximum voltage that may be imposed on the system, often as high as tens of thousands of volts for a distribution-level system. For safety, the insulating housing should be covered with a conductive layer that can be grounded. The switch should be operable from outside of the dielectric housing, without opening the housing and should be capable of withstanding many years of exposure to temperature extremes, water and environmental contaminants. The switch must also survive continued exposure to high voltages and withstand repeated operation. Most importantly, the switches must provide an easy and reliable indication of the position of the contacts.

Insulated switches using vacuum bottles do not provide means for visual inspection of the contacts to confirm that they are open (visible break) or closed. Prior art switches were designed with contacts in a large gas or oil filled cabinet which allowed a glass window to be installed for viewing the contacts. However, there is no means of directly viewing contacts in vacuum bottles since the bottles are made of metal and ceramic nontransparent materials. The seals required to maintain the vacuum inside the vacuum bottle prohibit the installation of a glass window. Newer high voltage switches combine vacuum switching with high dielectric strength EPDM rubber insulation as described in U.S. Pat. Nos. 5,667,060; 5,808,258; and 5,864,942 to Luzzi, all of which are incorporated herein in their entirety.

FIG. 1 shows a typical prior art insulated switch 900 using a vacuum bottle 902. The switch is sealed inside the vacuum bottle 902 and is hidden from view. The voltage source 904 and the load 906 are connected to the switch 900 but the switch contacts are not visible. The only means for determining the status of the switch contacts is the position of the switch handle 908. If the linkage between the handle 908 and the switch contacts is inoperative or defective, there is no positive indication that allows the operating personnel to determine the position of the contacts. Accordingly, the industry has recognized the need for insulated switches using vacuum bottles that provide a reliable indication of the position of the contacts.

SUMMARY OF THE INVENTION

In accordance with the present invention, a connector system for a high voltage vacuum switch is provided. The connector system includes: a voltage source connector; a load connector; a first contact in a vacuum bottle; and a second contact connected in series with the first contact, wherein the second contact is external to the vacuum bottle. The connector system connects a voltage source to a load through the first and second contacts using the voltage source connector and the load connector. The second contact is in a housing and includes a first separable interface, a second separable interface and a conducting pin. The housing can either be attached to an existing vacuum switch or the vacuum switch and the second contact can be manufactured in a single housing. Preferably, the housing is constructed from a solid dielectric material, most preferably EPDM rubber. In some embodiments, the connector system includes a sight glass which extends through the housing and which is located so that the conducting pin can be viewed through the sight glass. The connector system can also include a first connector for the first separable interface and a second connector for the second separable interface, which are used for test connections and/or grounding connections.

In another preferred embodiment, the connector system also includes: a key; a first lock for a manual operating mechanism that actuates the first contact to an open or a closed position; and a second lock for a bracket that secures the conducting pin in the housing. The key operates both the first and second locks and can only be removed from the first lock when the manual operating mechanism is positioned so that the first contact is open.

In a most preferred embodiment, the conducting pin is made of an electrically conductive material, such as copper, and is removable. After the first contact is open, the conducting pin can be removed and replaced with an insulating pin made of an electrically non-conductive material, preferably an elastomeric, plastic, ceramic or glass material. The conducting pin and insulating pin can also be color-coded so that they can be easily identified by the user. This allows the user to quickly and safely determine the position of the switch contacts and provides added protection to the personnel performing repairs and maintenance on high voltage circuits.

BRIEF DESCRIPTION OF THE FIGURES

The preferred embodiments of the connector system for an insulated switch of the present invention, as well as other objects, features and advantages of this invention, will be apparent from the following detailed description, which is to be read in conjunction with the accompanying drawings wherein.

DETAILED DESCRIPTION OF THE INVENTION

Figure 1:
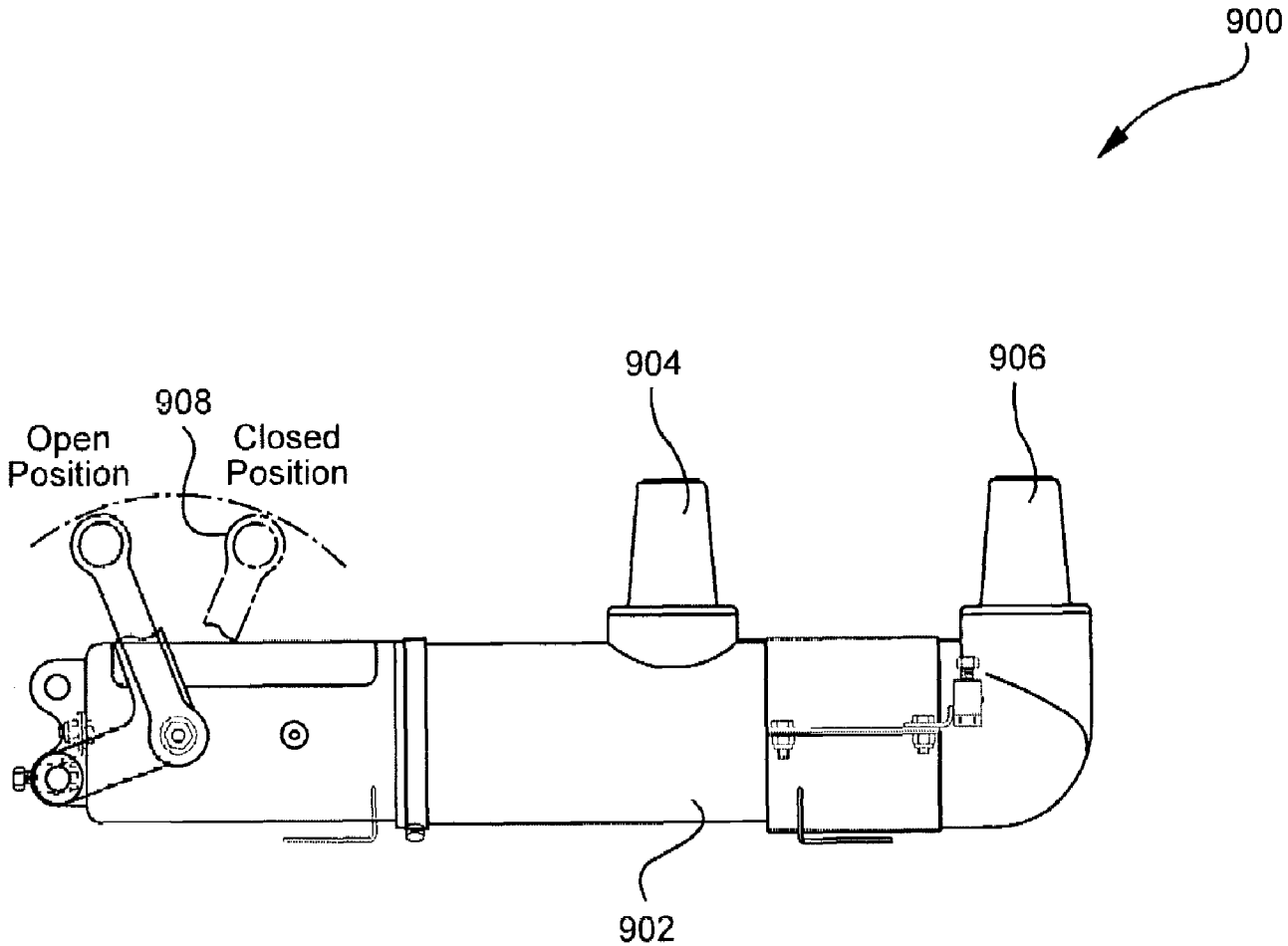
FIG. 1 Prior Art
FIG. 1 shows a prior art high voltage switch in a vacuum bottle.

The present invention is a connector system for high voltage vacuum switches that provides a second set of contacts in series with the contacts of insulated switches in a vacuum bottle. The second set of contacts can be opened independently from the contacts of the insulated switch to provide confirmation of an open circuit. The present invention also provides a means for grounding the load side of the bottle and the load side cable for down stream safe hands-on maintenance in a confined space.

The connector system includes a conducting pin (also referred to herein as a "pull-pin") that provides contact separation when it is removed. In contrast, prior art connector systems required the insulated connector component to be separated from the attached cable. One of the disadvantages of separating the insulated connector is that the large conductor cables that are typically connected to switchgear have limited flexibility. This makes it difficult to separate the two sections of the connector.

"Deadfront" vacuum switches are spring energy, load switching devices capable of making, carrying and interrupting load currents through about 600 amperes on 5-38 kV distribution systems. As used herein, the term "deadfront" refers to a switch having a molded rubber construction that insulates, shields and eliminates exposed live parts. Preferred embodiments of these switches combine vacuum switching with high dielectric strength EPDM rubber insulation and are described in U.S. Pat. Nos. 5,667,060; 5,808,258; and 5,864,942 to Luzzi, all of which are incorporated herein in their entirety.

The connector system for a high voltage vacuum switch of the present invention includes two contacts connected in series. Typically, the first contact is an existing high voltage vacuum switch in a vacuum bottle that is contained in a switch housing. The second contact is external to the vacuum bottle and contained in a separate housing which is connected to the switch housing. However, the first and second contacts can be manufactured as an integrated unit that includes both contacts in a single housing. Preferably, the housing is constructed from a solid dielectric material, most preferably ethylene propylene diene monomer ("EPDM") rubber. The connector system includes a voltage source connector for connecting the system to a high voltage source of at least 1 kV and a load connector for connection to a voltage load. The voltage source connector connects to the inlet side of the first contact and the outlet side of the first contact connects in series to the inlet side of the second contact. The outlet side of the second contact then connects to the load connector so that the voltage source is connected to the load through the first and second contacts.

The second contact can include a first separable interface and a second separable interface that are connected by a conducting pin. The conducting pin is made from electrically conductive material, such as copper and, preferably, can be removed when the first contact is open. After the conducting pin is removed, an insulating pin formed from an electrically non-conductive material can be installed between the first separable interface and the second separable interface to guarantee that the voltage source has been disconnected from the load. The status of the conducting and/or insulating pin can be monitored visually through a sight glass that extends through the housing. The sight glass allows the user to verify that the switch is open or closed. In preferred embodiments, the conducting pin and insulating pin are color coded to allow fast and easy visual identification.

The connector system can also include a first connector for the first separable interface and a second connector for the second separable interface. The first and second connectors are used for test connections and/or grounding connections. The first connector allows the user to conduct a voltage test to verify that the first contact in the vacuum bottle is open. After verifying that the first contact is open, a first grounding cable can be connected to the first connector. A voltage test can then be performed using the second connector and after the user verifies that the circuit is open, a second grounding cable can be attached. Grounding both sides of the second contact provides added safety for users conducting repairs and routine maintenance.

As an additional safety measure, the connector system can also have a key-lock system that includes a key and a pair of locks. The first lock is for a manual operating mechanism that actuates the first contact to an open or a closed position. The second lock is for a bracket that secures the conducting pin in the housing. One key operates both locks. The key must be in the first lock in order to operate the manual operating mechanism to close the first contact. The key cannot be withdrawn from the first lock as long as the first contact is closed. This ensures that the key cannot be used to unlock the bracket and remove the conducting pin from the housing while the voltage source is connected to the load. When the manual operating mechanism is in the open position, the key can be turned and withdrawn from the first lock. Turning the key locks the manual operating mechanism in the open position and it can only be switched to the closed position after the user has inserted and turned the key.

After the key is taken out of the first lock, it can be inserted in the second lock and used to unlock the bracket from the housing. The bracket secures the plug assembly, which includes the conducting pin or insulating pin, in the housing and the plug assembly cannot be removed without first removing the bracket. Removing the bracket allows the plug assembly to be withdrawn from the housing. When the switch is being disconnected, the plug assembly is taken out of the housing and the conducting pin is replaced by an insulating pin. The plug assembly is then reinserted into the housing and the insulating pin remains in position between the first separable interface and the second separable interface while the first contact is in the open position. Preferably, the conducting pin is made from an electrically conductive material and the insulating pin is made from an electrically non-conductive material. The preferred electrically conductive material is copper and the preferred electrically non-conductive material can be an elastomeric, plastic, ceramic or glass material.

The conducting pin has a first end that electrically connects to the first separable interface at a first contact point, a second end that connects to the plug, preferably with a threaded connection, and a midpoint. The conducting pin also has a second contact point between the second end and the midpoint that connects to the second separable interface. The conducting pin is sized so that its diameter varies along its length with the diameter of the first end less than the diameter of the second end. Preferably, the diameter of the first end at the first contact is small enough so that, when the conducting pin is inserted into the housing, it passes through the second separable interface, but large enough so that it snugly engages the first separable interface. The diameter of the conducting pin at the second contact point is selected so that it electrically engages the second separable interface when the conducting pin is inserted into the housing. The conducting pin can be tapered with the diameter gradually increasing from the first end to the second end. The conducting pin can also be designed so that the portion from the first end up to the second contact point has a first diameter and the portion of the conducting pin from (and including) the second contact point to the second end has a second diameter, wherein the first diameter is small enough to allow the first end to pass through the second separable interface. Preferably, the conducting has a first diameter at the first contact point and a second diameter, which is greater then the first, at the second contact point. The dimensions of the insulating pin are substantially the same as the dimensions of the conducting pin.

The description that follows is based on a single-phase switch for ease of description. However, the same description applies to a three-phase switch, which has three legs that are identical to a single phase switch connected to a common actuating mechanism.

Figure 2:
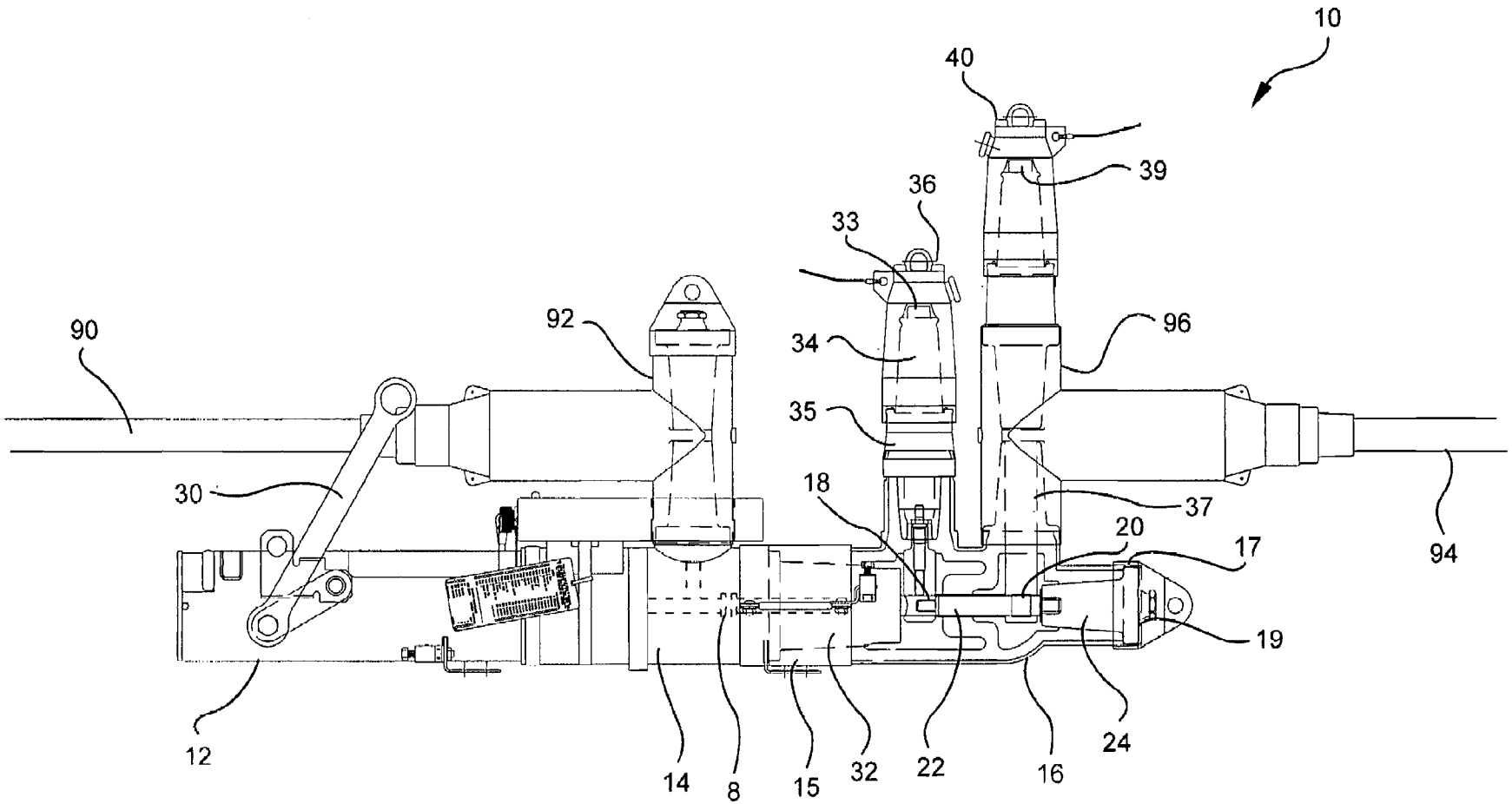
FIG. 2 shows the connector system connected to a high voltage switch in a vacuum bottle.

FIG. 2 shows an embodiment of the connector system 16 wherein a switch assembly 10 is formed by attaching the connector system 16 to a switch contact 8 in a vacuum bottle 14. The connector system 16 replaces the standard switch assembly end fitting 906 used in the prior art (see FIG. 1). The connector system 16 contains two separable connector contacts 18, 20 that are connected internally with a conducting pin 22. The first separable connector contact 18 electrically connects to the output from the contact 8 in the vacuum bottle 14 and to a current carrying bushing 35. A connecting post 34 with a direct test connection 33 is connected to the bushing 35. The second separable connector contact 20 electrically connects to a current carrying bushing 37 that connects to the load 94. The conducting pin 22 electrically connects the two separable connector contacts 18, 20 and is attached to an insulated plug 24. The connector system 16 has a first end 15 that connects to the switch 8 and a second end 17 through which the connecting pin 22 is accessed. The conducting pin 22/plug 24 assembly can be removed through an aperture 19 in the second end 17 of the housing when the switch contact 8 is open to guarantee connection separation. After the conducting pin 22 is removed, it is replaced with an insulated rod 26 and plug 24 assembly (see FIG. 7) to maintain electrical separation and provide a sealed cover for the housing.

Referring again to FIG. 2, it can be seen that a voltage source 90 connects to the switch assembly 10 using a cable elbow 92. The switch contact 8 in the vacuum bottle 14 is actuated by a manual handle 30 connected to the actuating mechanism 12. When the switch contact 8 is closed, the voltage source 90 passes through the vacuum bottle 14 to the output connector 32 and then to the connector system 16. When the connector system 16 is in the closed position, the two separable connector contacts 18, 20 are electrically connected by the conducting pin 22. The output from the connector system 16 is then connected to a load 94 through a cable elbow 96.

Figure 3:
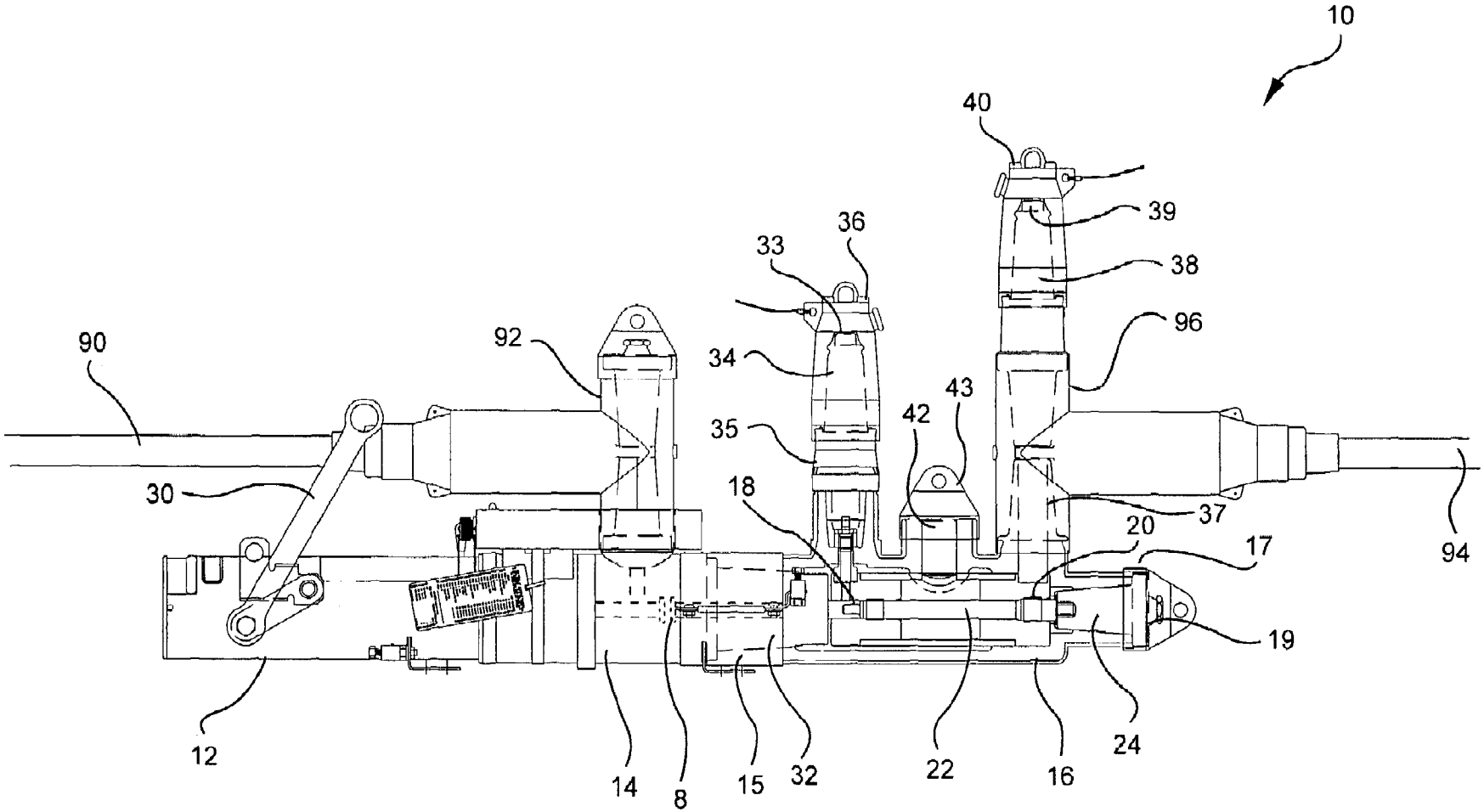
FIG. 3 shows the connector system having a sight glass connected to a high voltage switch in a vacuum bottle with the switch in a closed position.

Looking now at FIG. 3, there is shown a preferred embodiment of the present invention in which the connector system 16 includes a sight glass 42 with a protective cap 43 located between the two separable connector contacts 18, 20. The sight glass 42 allows the user to visually examine the connecting pin 22 and determine whether or not it has been removed and that the connector system 16 is open. FIGS. 3 through 7 show the sequence of operation for opening the connector system 16 and verifying the open condition. One of the important features of the connector system 16 is that the voltage source 90 can be physically separated and electrically disconnected from the load 94 without removing either of the cable elbows 92, 96. This feature is especially useful in applications where the switch assembly 10 is mounted in an enclosure with restricted space for removing the cable elbows 92, 96.

The connector system 16 in FIG. 3 shows the conducting pin 22 in the closed position. In this configuration, voltage from the source 90 passes through to the load 94 when the switch contact 8 in the vacuum bottle 14 is in the closed position. The two separable connector contacts 18, 20 are provided with test connections 33, 39 so that a testing device can be connected to each side of the conducting pin 22 to measure the voltage. When the test connections 33, 39 are not being used, they are covered with insulated caps 36, 40. The combination of the switch assembly 10 that includes the connector system 16 provides increased user safety and protection by using two separate contacts in series. The first switch contact 8 is in the vacuum bottle 14 and the second contact is formed by the conducting pin 22 of the connector system 16. After the operating handle 30 is in the open position, the conducting pin 22 is removed and the grounding elbows 80, 82 are connected (see FIG. 7), the user can be certain that it is safe to conduct repairs and/or maintenance.

Figure 4:
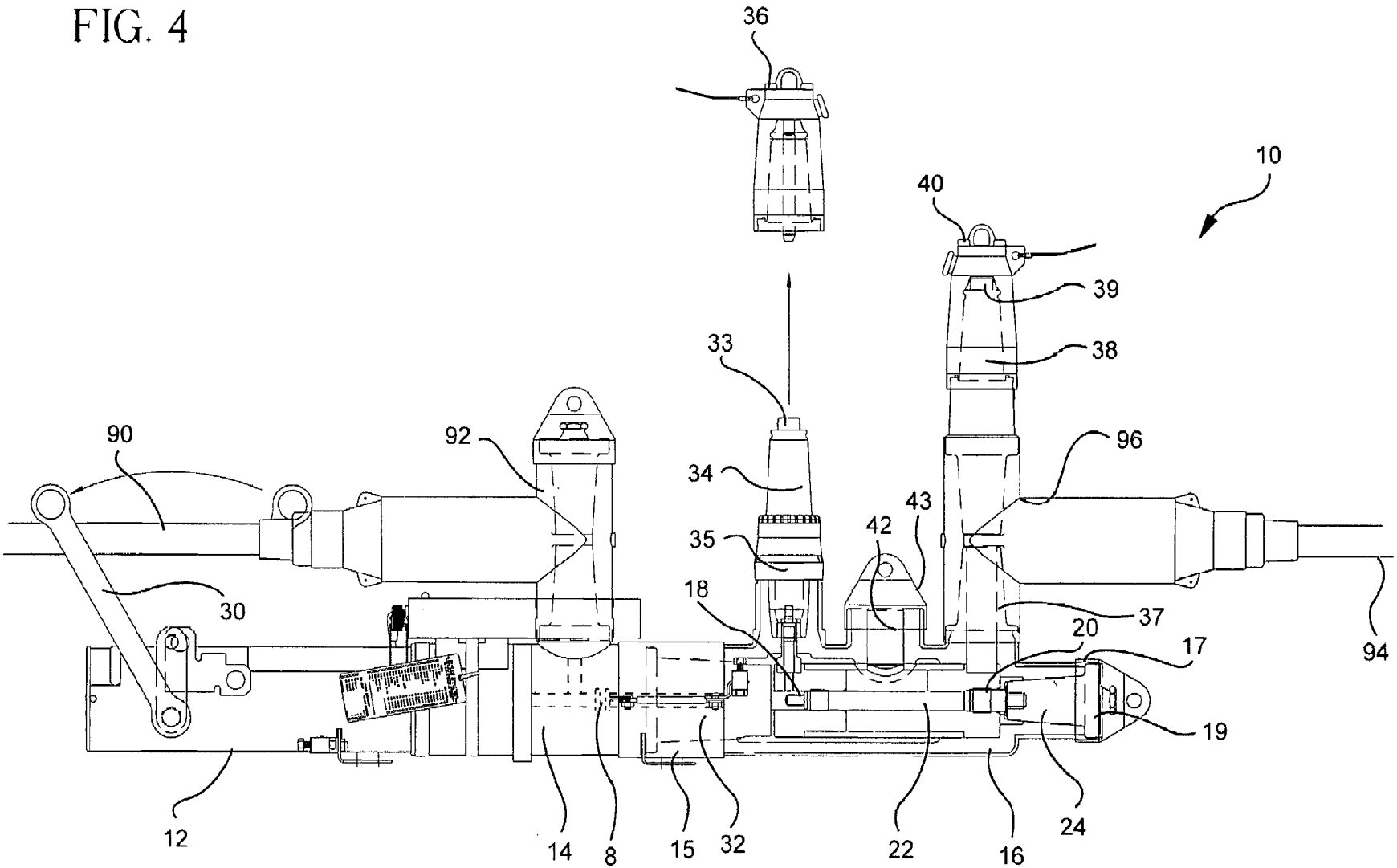
FIG. 4 shows the connector system having a sight glass connected to a high voltage switch in a vacuum bottle with one of the insulated caps removed and the switch in an open position.
Figure 5:
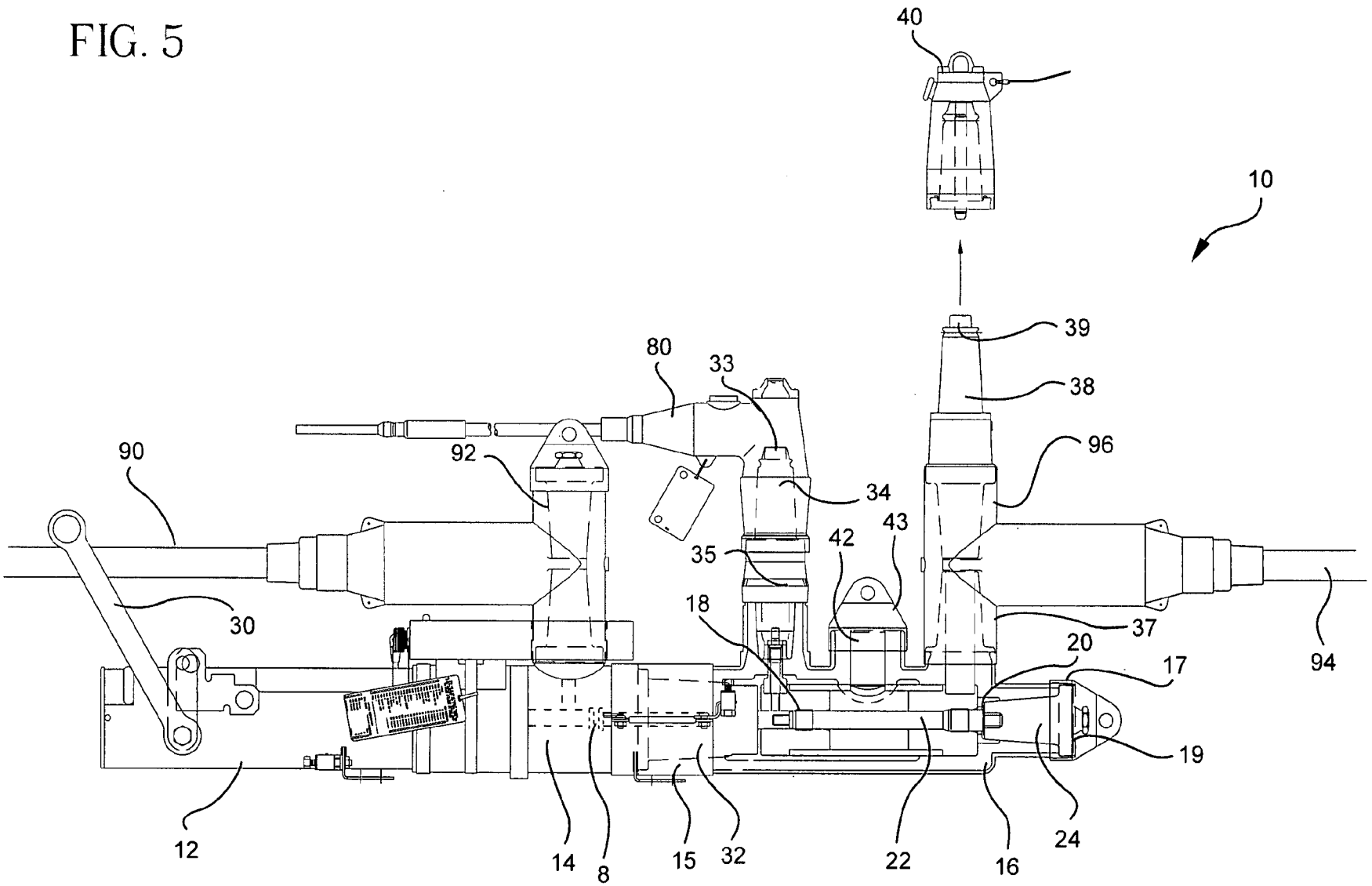
FIG. 5 shows the connector system having a sight glass connected to a high voltage switch in a vacuum bottle with one side of the connector system grounded and the insulated cap for the other side removed.

FIG. 4 shows the handle 30 for the actuating mechanism 12 in the open position and the insulated cap 36 removed from the first separable connector 18 in preparation for a direct voltage test. The direct voltage test confirms that the switch contact 8 in the vacuum bottle 14, which cannot be viewed, is open. After the voltage test confirms that the output of the switch assembly 10 is zero volts (i.e., the switch contact 8 in the vacuum bottle 14 is open), a first grounding elbow 80 is attached to the connecting post 34 as shown in FIG. 5. Subsequently, the insulated cap 40 is removed from the loadbreak tap plug 38 and test connection 39 is used to test the voltage on the second separable connector 20 side of the connector system 16.

Figure 6:
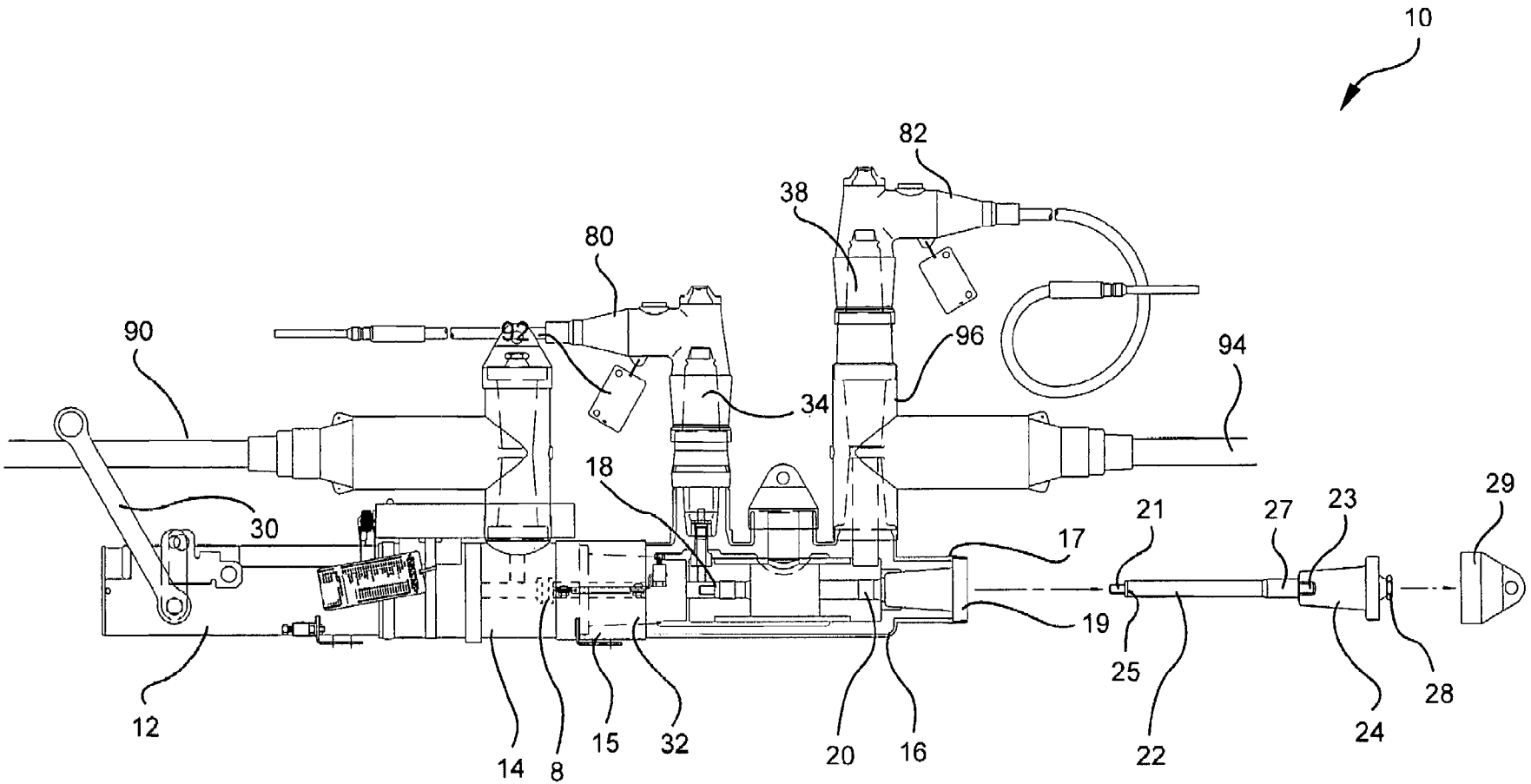
FIG. 6 shows the connector system having a sight glass connected to a high voltage switch in a vacuum bottle with the two sides of the connector system grounded and the conducting pin removed.
Figure 7:
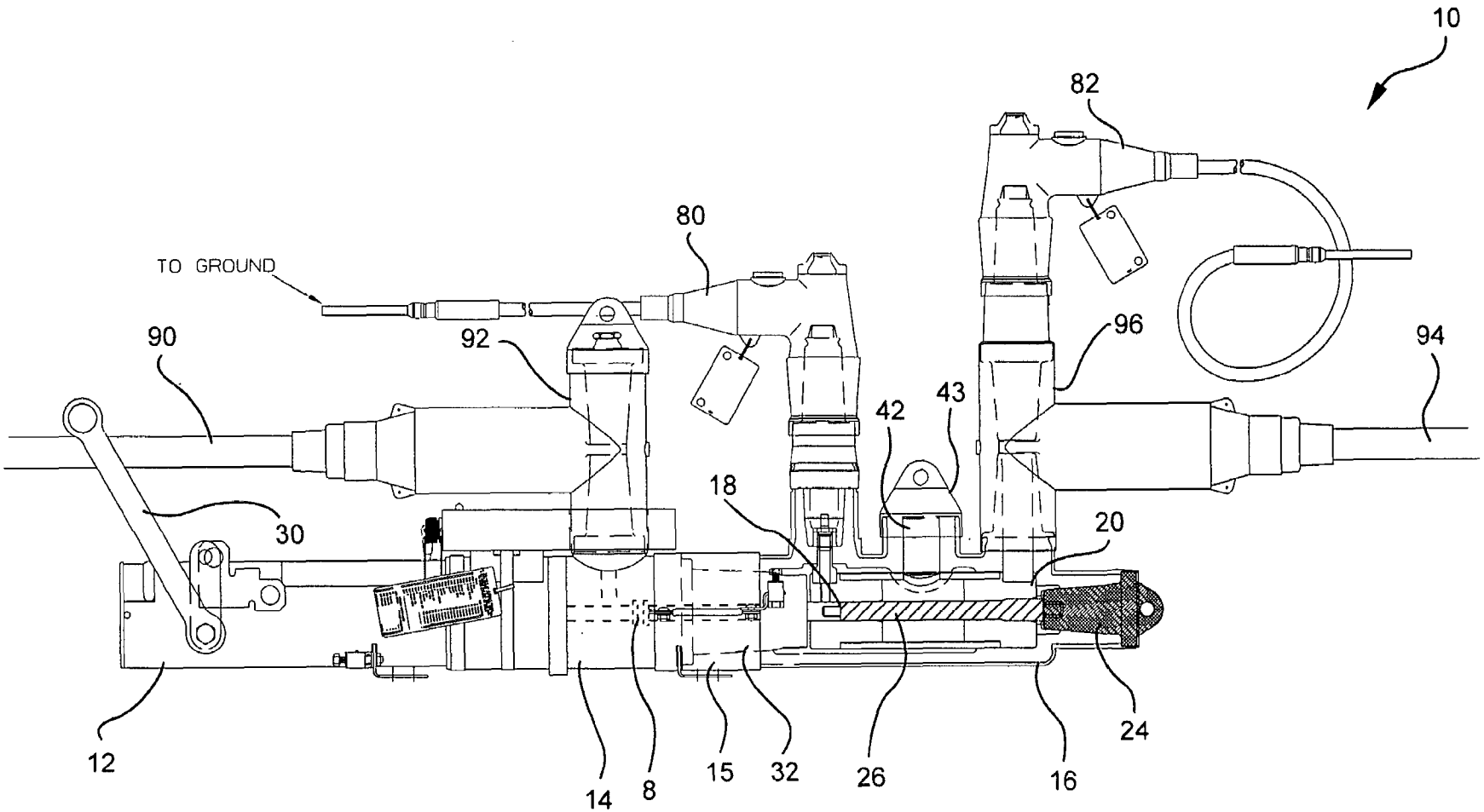
FIG. 7 shows the connector system having a sight glass connected to a high voltage switch in a vacuum bottle with the two sides of the connector system grounded and the conducting pin replaced by an insulating pin.

Referring to FIG. 6, it can be seen that a first grounding elbow 80 is connected to the connecting post 34 to ground the source side 90 of the vacuum switch contact 8 and a second grounding elbow 82 is connected to the loadbreak tap plug 38 to ground the load 94 side of the connection system 16. Grounding the source side 90 and the load side 94 places the connector system 16 in a safe condition and allows the conducting pin 22 to be safely removed without disconnecting the grounding elbows 80, 82. An insulating pin 26, preferably with a highlighted color such as yellow for easy identification, and plug 29 are inserted in the aperture 17 in the connector system 16 to increase the insulation level between the open points, i.e. the two separable connector contacts 18, 20, and seal the aperture 19 as shown in FIG. 7. Visual confirmation that the conductive pin 22 has been removed or that the insulating pin 26 has been inserted, is provided using the sight glass 42 (also referred to herein as the viewing port).

The load 94 is reconnected to the source 90 by reversing the operation described above. First, the insulating pin 26 is removed and the conducting pin 22 is installed in the connector system 16. The second grounding elbow 82 is removed from the loadbreak tap plug 38 and the insulated cap 40 is installed. The first grounding elbow 80 is then removed from the connecting post 34 and the insulated cap 36 is installed. The switch handle 30 is moved into the closed position to close the switch contact 8 in the vacuum bottle 14 and reconnect the load 94 to the source 90.

Figure 8:
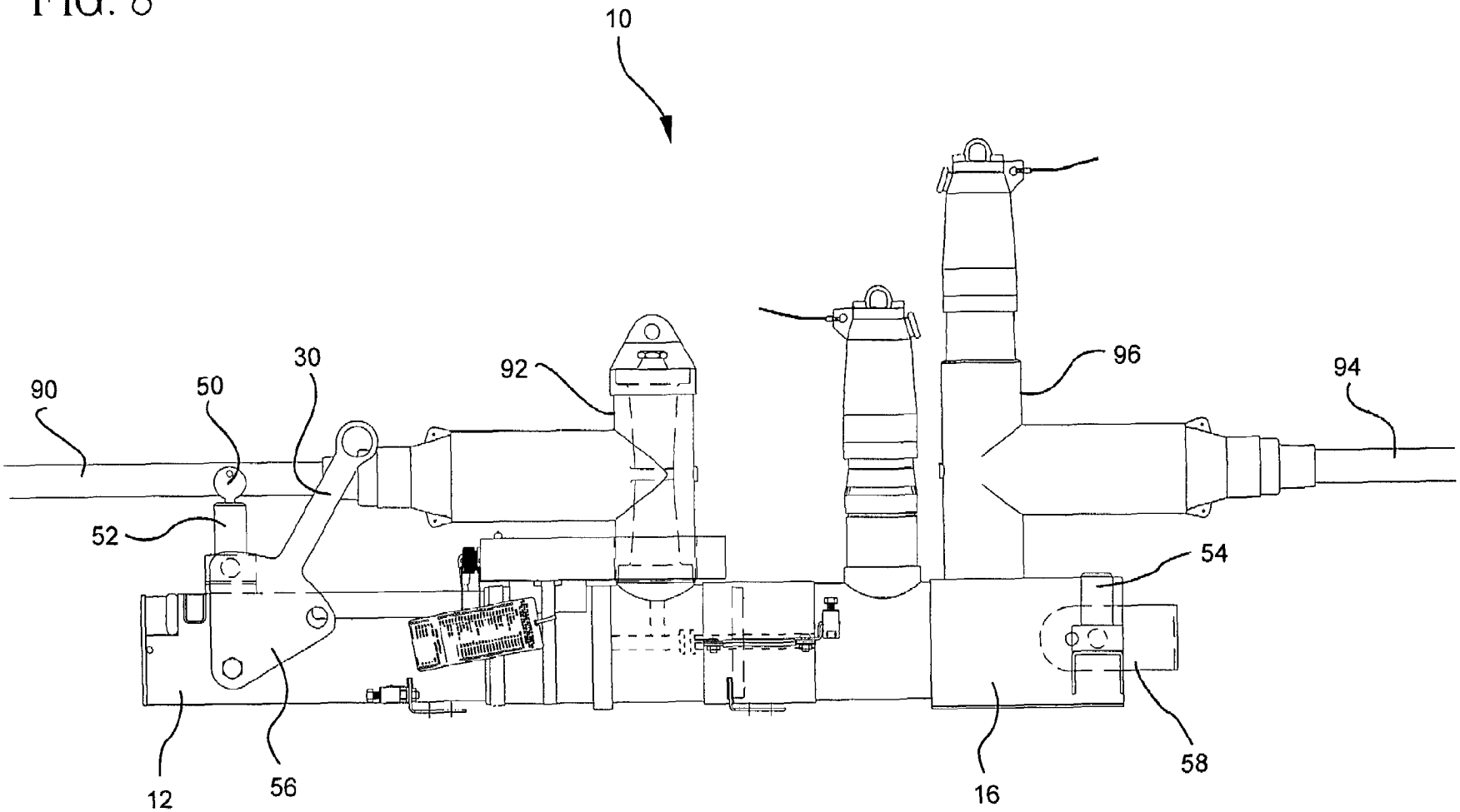
FIG. 8 shows the connector system connected to a high voltage switch in a vacuum bottle with a locking system and the switch handle in the closed position.
Figure 9:
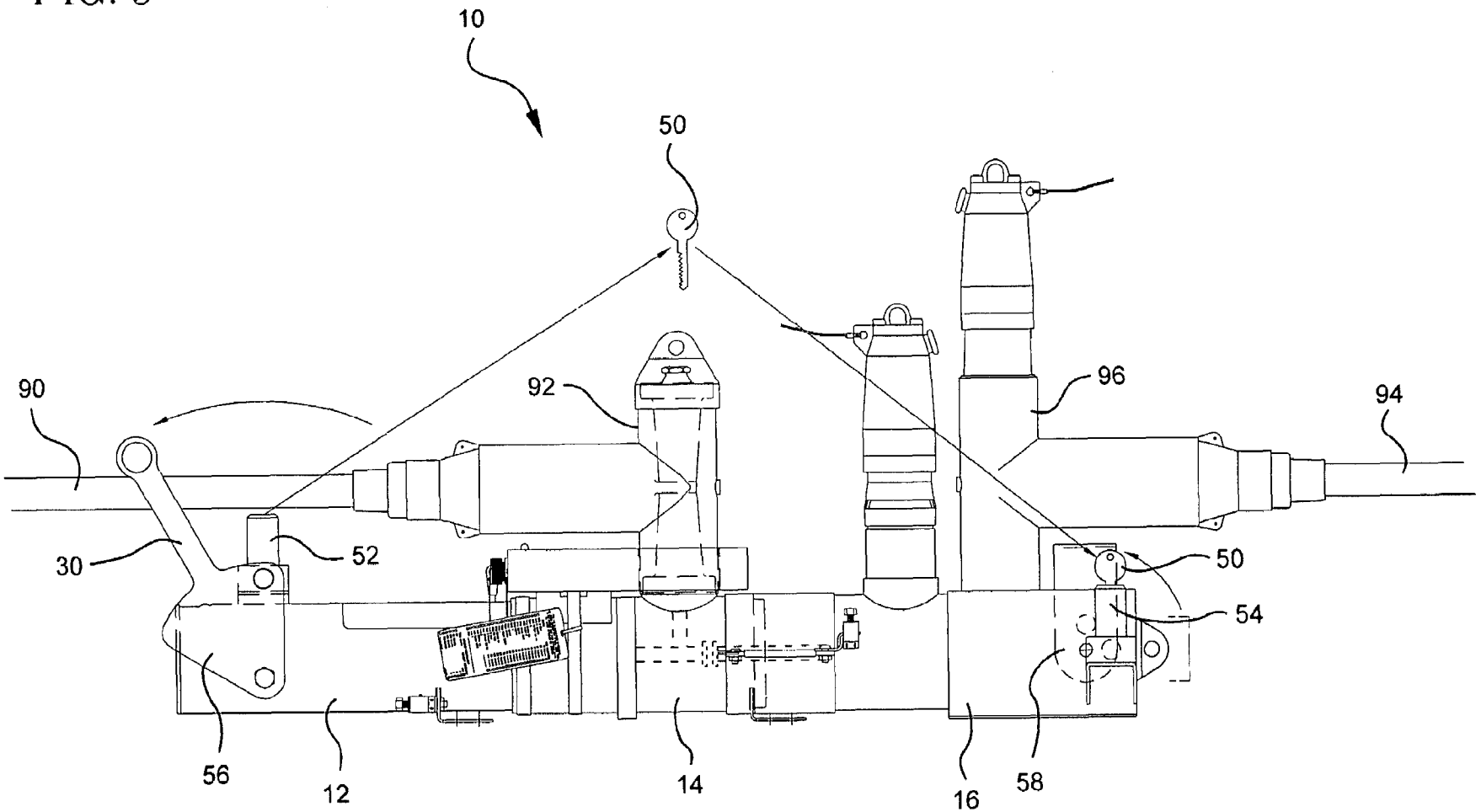
FIG. 9 shows the connector system connected to a high voltage switch in a vacuum bottle with a locking system and the switch handle in the open position with the key removed.
Figure 10:
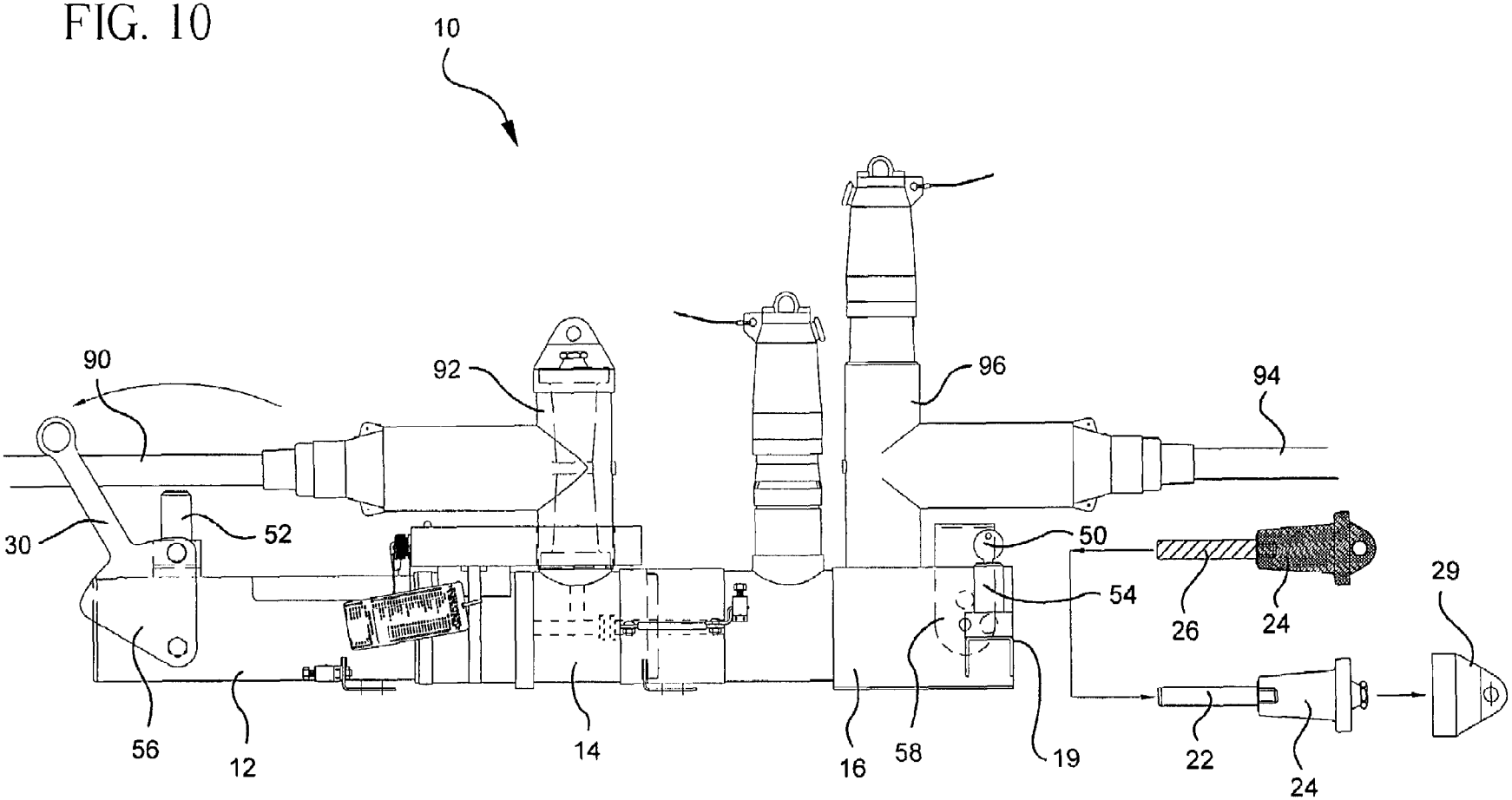
FIG. 10 shows the connector system connected to a high voltage switch in a vacuum bottle with a locking system in the open position and the conducting pin removed.

In another preferred embodiment, an interlock system is used to ensure that the conducting pin 22 is not removed before the switch assembly 10 is in the open position. When the switch handle 30 is in the closed position, it captures a key 50 in a first lock 52 on the handle assembly 56. The key 50 cannot be removed from the first lock 52 until the switch handle 30 is moved to the open position. This same key 50 is then used to open a second lock 54, which secures a bracket 58 to the housing of the connector system 16 and prevents the plug 24 and the conducting pin 22 from being removed. FIGS. 8 through 10 show how the interlock system (including the key 50 and two locks 52, 54) functions. Moving the switch handle 30 to the open position releases the key 50 from the first lock 52. Only after the switch handle 30 is opened can the key 50 be taken out of the first lock 52 and used to open the second lock 54 and remove the bracket 58 that captures the plug 24. This permits the pull-pin assembly (i.e. the conducting pin 22 and plug 24) to be removed. The two locks 52, 54 ensure that the conducting pin 22 can only be removed when the switch handle 30 is in the open position.

In a preferred embodiment, the conducting pin 22 shown in FIG. 6 has a threaded tip 21 for connecting the conducting pin 22 to the first separable connector 18. The conducting pin 22 is constructed so that it has two diameters, a first diameter 25 and a second diameter 27, wherein the second diameter 27 is larger than the first diameter 25. When the conducting pin 22 is inserted through the aperture 19 in the second end 17 of the connecting system 16, the first diameter 25 is sized so that it easily passes through the second separable connector 20 and engages the first separable connector 18. When the threaded tip 21 of the conducting pin 22 is screwed into the first separable connector 18, the second diameter 27 engages the second separable connector 20 to form an electrical connection. The rear end 23 of the conducting pin 22 is attached to the plug 24, preferably by a threaded connection. The plug 24 can have an aperture 28 for receiving a tool which can be used to rotate the conducting pin 22 and a cap 29, which is placed over the plug 24 after it is installed in the aperture 19. In another preferred embodiment, the conducting pin 22 is tapered so that the tip 21 has a smaller diameter than the rear end 23, which allows the tip 21 to pass through the second separable connector 20 before engaging the first separable connector 18.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A connector system for a high voltage vacuum switch comprising:

a voltage source connector;

a load connector;

a first contact in a vacuum bottle; and a second contact connected in series with the first contact, wherein the second contact is in a housing external to the vacuum bottle and comprises a first separable interface, a second separable interface and a conducting pin or an insulating pin, wherein the conducting pin electrically connects the first separable interface and the second separable interface or the insulating pin electrically insulates the first separable interface and the second separable interface;

wherein the conducting pin or the insulating pin are selectively installed between the first separable interface and the second separable interface through an aperture in the housing and, when the conducting pin is installed, the voltage source is connected to the load through the first and second contacts.

2. The connector system for a high voltage vacuum switch according to claim 1, further comprising a housing, wherein the conducting pin or the insulating pin is connected to a plug that extends through the aperture in the housing.

3. The connector system for a high voltage vacuum switch according to claim 1, further comprising a sight glass, wherein the second contact can be viewed through the sight glass.

4. The connector system for a high voltage vacuum switch according to claim 3, wherein the housing is constructed from EPDM rubber and wherein the sight glass extends through the housing.

5. The connector system for a high voltage vacuum switch according to claim 1, further comprising a first connector for the first separable interface and a second connector for the second separable interface.

6. The connector system for a high voltage vacuum switch according to claim 5, wherein the first and second connectors are used for test connections and/or grounding connections.

7. The connector system for a high voltage vacuum switch according to claim 1 further comprising:

a key;

a first lock for a manual operating mechanism that actuates the first contact to an open or a closed position; and a second lock for a bracket that secures the conducting pin in the housing, wherein the key operates both the first and second locks.

8. The connector system for a high voltage vacuum switch according to claim 7, wherein the key can only be removed from the first lock when the manual operating mechanism is positioned so that the first contact is in the open position.

9. The connector system for a high voltage vacuum switch according to claim 1, wherein the conducting pin is removable.

10. The connector system for a high voltage vacuum switch according to claim 9, wherein the conducting pin is removed and an insulating pin is installed between the first separable interface and the second separable interface.

11. The connector system for a high voltage vacuum switch according to claim 1, wherein the conducting pin is made from an electrically conductive material and the insulating pin is made from an electrically non-conductive material.

12. The connector system for a high voltage vacuum switch according to claim 11, wherein the insulating pin is made from an elastomeric, plastic, ceramic or glass material.

13. A connector system for a high voltage vacuum switch comprising:

a housing having an aperture;

a voltage source connector;

a load connector;

a first contact in a vacuum bottle;

a second contact connected in series with the first contact and external to the vacuum bottle, wherein the second contact is in the housing and comprises a first separable interface, a second separable interface and a removable conducting pin or a removable insulating pin, wherein the removable conducting pin or the removable insulating pin is removable through the aperture in the housing and wherein, when the removable conducting pin is installed, the removable conducting pin electrically connects the first separable interface and the second separable interface; and a sight glass which extends through the housing, wherein the removable conducting pin or the removable insulating pin can be viewed through the sight glass;

wherein, when the conducting pin is installed, the voltage source is connected to the load through the first and second contacts.

14. The connector system for a high voltage vacuum switch according to claim 13, further comprising a first connector for the first separable interface and a second connector for the second separable interface, wherein the first and second connectors are used for test connections and/or grounding connections.

15. The connector system for a high voltage vacuum switch according to claim 13, wherein, when the removable conducting pin is removed and the removable insulating pin is installed, there is no electrical connection between the first separable interface and the second separable interface.

16. The connector system for a high voltage vacuum switch according to claim 15, wherein the removable conducting pin is made from an electrically conductive material and the removable insulating pin is made from an electrically non-conductive material.

17. The connector system for a high voltage vacuum switch according to claim 13, wherein the housing is constructed from EPDM rubber.

18. The connector system for a high voltage vacuum switch according to claim 13 further comprising:

a key;

a first lock for a manual operating mechanism that actuates the first contact to an open or a closed position; and a second lock for a bracket that secures the conducting pin in the housing, wherein the key operates both the first and second locks and wherein the key can only be removed from the first lock when the manual operating mechanism is positioned so that the first contact is in the open position.

19. A connector system for a high voltage vacuum switch comprising:

a housing having an aperture;

a voltage source connector;

a load connector;

a first contact in a vacuum bottle;

a second contact connected in series with the first contact and external to the vacuum bottle, wherein the second contact is in the housing and comprises a first separable interface, a second separable interface and a removable conducting pin or a removable insulating pin, wherein the removable conducting pin or the removable insulating pin is removable through the aperture in the housing and wherein, when the removable conducting pin is installed, the removable conducting pin electrically connects the first separable interface and the second separable interface;

a first connector for the first separable interface and a second connector for the second separable interface, wherein the first and second connectors are used for test connections and/or grounding connections; and a sight glass which extends through the housing, wherein the removable conducting pin or the removable insulating pin can be viewed through the sight glass;

wherein, when the conducting pin is installed, the voltage source is connected to the load through the first and second contacts.

20. The connector system for a high voltage vacuum switch according to claim 19, wherein, when the removable conducting pin is removed and the removable insulating pin is installed, there is no electrical connection between the first separable interface and the second separable interface and wherein the conducting pin is made from an electrically conductive material and the insulating pin is made from an electrically non-conductive material.

21. The connector system for a high voltage vacuum switch according to claim 19 further comprising:

a key;

a first lock for a manual operating mechanism that actuates the first contact to an open or a closed position; and a second lock for a bracket that secures the conducting pin in the housing, wherein the key operates both the first and second locks and wherein the key can only be removed from the first lock when the manual operating mechanism is positioned so that the first contact is in the open position.

* * * * *